US006175992B1

(12) United States Patent
Sauerland

(10) Patent No.: US 6,175,992 B1
(45) Date of Patent: Jan. 23, 2001

(54) HINGE LINE FOR METAL LOCKERS IN ALIGNMENT, WITH EXTERNAL JOINT AXIS

(75) Inventor: Manfred Sauerland, Essen (DE)

(73) Assignee: EMKA Beschlagteile GmbH & Co. KG (DE)

( * ) Notice: Under 35 U.S.C. 154(b), the term of this patent shall be extended for 0 days.

(21) Appl. No.: 09/297,215

(22) PCT Filed: Oct. 22, 1997

(86) PCT No.: PCT/DE97/02430

§ 371 Date: Apr. 22, 1999

§ 102(e) Date: Apr. 22, 1999

(87) PCT Pub. No.: WO98/17886

PCT Pub. Date: Apr. 30, 1998

(30) Foreign Application Priority Data

Oct. 22, 1996 (DE) ..... 296 18 406 U

(51) Int. Cl.[7] ..... E05D 5/00

(52) U.S. Cl. ..... 16/382; 16/254; 16/252; 16/270

(58) Field of Search ..... 16/382, 254, 252, 16/387, 388, 389, 270

(56) References Cited

U.S. PATENT DOCUMENTS 511,050 * 12/1893 Irwin ..... 16/252
4,010,504 * 3/1977 Griffin ..... 16/252
4,827,568 * 5/1989 Ramsauer ..... 16/382
4,914,781 * 4/1990 Sokn et al. ..... 16/388
4,937,916 * 7/1990 Redman ..... 16/382
5,259,091 * 11/1993 Mordick ..... 16/254
5,906,028 * 5/1999 Whisman et al. ..... 16/382

FOREIGN PATENT DOCUMENTS 42 24 468 C1 7/1992 (DE) .
0 223 871 B1 6/1987 (EP) .
0 466 289 A1 1/1992 (EP) .

* cited by examiner

*Primary Examiner*—Chuck Y. Mah
(74) *Attorney, Agent, or Firm*—Robert W. Becker & Associates

(57) ABSTRACT

A hinge for metal cabinets has a first bearing support mounted to a body of a metal cabinet. A second U-shaped bearing support is attached to the door leaf of the metal cabinet by being inserted into a cutout provided in a corner area of an angled portion of the door leaf. The angled portion extends toward the body of the metal cabinet. A rotation axle of the hinge mounted in the first bearing support is positioned at an external side of the door leaf in the area of the angled portion. The second bearing support has a first bore. A fastener is received in the first bore for attaching the second bearing support to the door leaf. The first bore extends angularly to the door leaf and the angled portion. A U-shaped support bracket has U-legs embracing the second bearing support. The U-legs rests on the door leaf and the angled portion. The support bracket is provided with a second bore for penetration by the fastener.

8 Claims, 1 Drawing Sheet

HINGE LINE FOR METAL LOCKERS IN ALIGNMENT, WITH EXTERNAL JOINT AXIS

BACKGROUND OF THE INVENTION

The invention relates to a hinge for a metal cabinet, in particular, a switch cabinet, and is comprised of a first bearing support attached to the body of the metal cabinet and a second U-shaped bearing support mounted to the door of the metal cabinet and embracing the first bearing support, the door leaf having an angled portion extending toward the body of the metal cabinet and the second bearing support attached to the door leaf being inserted into a cutout provided in the area of the angled portion of the door. For cabinets mounted in a row, the rotation axle of the hinge is located external to the corner area formed by the angled portion of the door leaf.

A hinge with the aforementioned features is described in EP 0 223 871 B2; the second bearing support of this prior art hinge is attached to the door leaf by means of a clamping pin arrangement, wherein this clamping pin arrangement extend past the cutout area into the corner area formed by the angled portion and the door leaf and thereby secures in the cutout the second bearing support that is inserted into the door cutout. The clamping pin arrangement is embodied as a pin that penetrates both bearing supports.

The known hinge has the disadvantage with respect to the attachment of the second bearing support at the door that the arrangement of a clamping pin penetrating both bearing support s requires a special and complicated design of the first bearing support that is to be mounted on the cabinet body because the legs of this bearing support that project toward the door leaf have to be provided with a laterally open bore or recess for receiving the clamping pin when the door is closed. Furthermore, the stability of the door or of the corner area formed by the door and its angled portion, is negatively affected by the cutout provided there so that the door can be deformed in the area of the corner area when an according force acts on the hinge. Furthermore, the use of a clamping pin can be questionable with respect to various door leaf thicknesses and also the clamping pin cannot be handled in a reliable manner because it can be driven in either too tightly or too loosely. Furthermore, a clamping pin with a different and adjusted taper will have to be provided for each door leaf thickness.

It is therefore an object of the invention to suggest an attachment of the second bearing support at the door for a hinge of the aforementioned kind, with which the aforementioned disadvantages are prevented.

SUMMARY OF THE INVENTION

The solution to this object, including advantageous embodiments and further developments of the invention can be seen from the contents of the claims which follow this description.

The invention provides in its basic idea that, for attaching the second bearing support to the door leaf, the second bearing support is provided with a bore, extending angularly with its longitudinal axis to the door leaf and its angled portion, for receiving a fastener and is also provided with a U-shaped support bracket that embraces with its U-legs the second bearing support. The U-legs are supported on the door leaf and on the angled portion, and the support bracket is provided with a bore for penetration by the fastener. The invention has the advantage that by using the extra support bracket for attaching the second bearing support to the door leaf, the support action is moved outside of the weakened corner area and a support action of the support bracket is created against the angled portion of the door leaf. Thereby, the corner area of the door, weakened by the cutout is relieved. Providing an extra support bracket results in the use of the hinge to be independent from the thickness of the door because the pressure of the support bracket against the door or the angled portion, respectively, can be adjusted by the fastening bolt connecting the support bracket and the second bearing support. Finally, manipulation of the fastener is easy when the second bearing support is securely attached to the door.

One embodiment of the invention provides that the U-legs of the support bracket embrace the second bearing support above and below it, relative to the vertical axis of the metal cabinet, and extend into the corner area formed by the door leaf and its angled portion. It can be provided that the U-legs of the support bracket are provided with side surfaces which are aligned with the door leaf and its angled portion, respectively, and which rest against the door leaf and its angled portion when the fastener is inserted. Such an embodiment has the advantage that especially the corner areas above and below the cutout that receives the second bearing support is further stabilized by mounting the support bracket.

Alternatively, it can be provided that the U-legs of the support bracket laterally embrace the second bearing support parallel to the vertical axis of the metal cabinet and, with their end face areas, rest on the door leaf and on its angled portion.

In order to prevent shifting of the support bracket when the hinge is mounted, one embodiment of the invention can provide that the side surfaces of the U-legs of the support bracket are provided with pointed projections so that, when the fasteners is tightened, the pointed projections penetrate into the abutting surfaces of the door leaf or into the angled portion thereof, respectively. By this means a switch cabinet, for example, without switching devices in the door sheet metal, is also sufficiently grounded in accordance with the applicable standard.

According to different embodiments of the invention, the axis of the bore within the second bearing support for receiving the fastener can be aligned either with the angle bisector of the angle that is being formed by the door and its angled portion or the axis can extend at an angle to this imaginary line such that the angle bisector is intercepted in one direction or the other.

It is advantageous when the bore is a threaded bore and the fastener is a screw bolt.

BRIEF DESCRIPTION OF THE DRAWINGS

The drawing illustrates one embodiment of the invention which will be described in the following. It is shown in.

DESCRIPTION OF PREFERRED EMBODIMENTS

Figure 1:
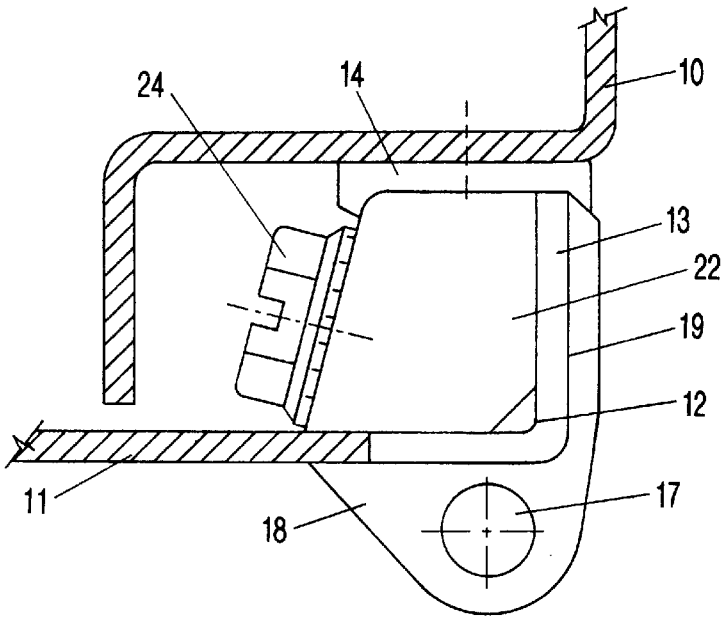
FIG. 1 a hinge mounted on a cabinet body and a door, in a plan view.

As can be seen in FIG. 1, the hinge serves as a mounting support of a door leaf 11 at a cabinet body 10; the door leaf is provided with an angled portion 13 pointing toward the cabinet body, so that a corner area 12 is formed.

Figure 2:
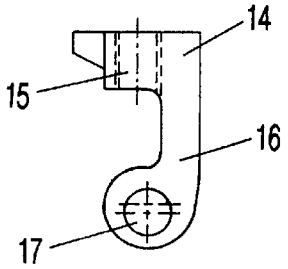
FIG. 2 the first bearing support attached to the cabinet body, in a plan view, FIG. 3 the second bearing support attached to the door, in a plan view, FIG. 4 the support bracket for attaching the second bearing support illustrated in FIG. 3, in a plan view, FIG. 5 the object of FIG. 4, in a side view.

As can be seen from FIG. 2, the hinge is comprised of a first bearing support 14, attached to the cabinet body 10 by bore 15 provided at the first bearing support 14 and of a leg 16 that extends from the cabinet body 10 toward the door leaf 11. At the end of the leg 16 that extends up to the corner area 12, the rotation axle 17 of the hinge is arranged.

Figure 3:
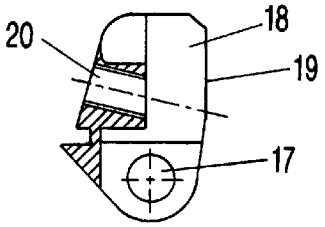

FIG. 3 shows an individual illustration of the second bearing support 18 which is inserted into an angled portion, not illustrated in detail, that is provided at the corner area 12 within the door leaf 11 and the angled portion 13, and which can be attached to the door leaf 11 so that edges 19 of the second bearing support 18 embrace the rim portion of the cutout. For attaching the second bearing support 18, a bore 20 is provided for receiving a fastener 24 illustrated in FIG. 1. The bore 20 of the illustrated embodiment is a threaded bore and the fastener is a screw bolt. The bore for fastening extends with its axis approximately slanted relative to the corner area 12 so that the axis of the bore 20 crosses an imaginary angle bisector of the angle that is formed by the door leaf 11 and the angled portion 13.

Figure 4:
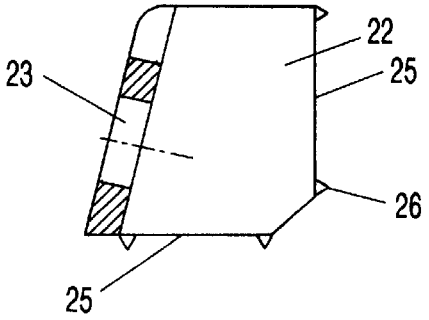
Figure 5:
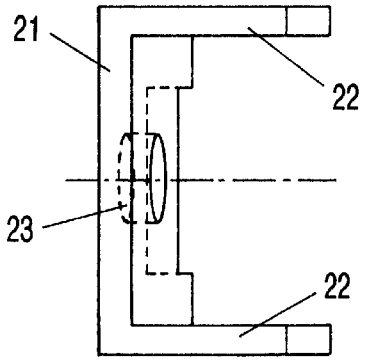

For fastening the second bearing support 18, a separate support bracket 21 is provided which is shown in detail in FIGS. 4 and 5. The support bracket 21 is U-shaped such that its U-legs 22 embrace the second bearing support 18 above and below it, relative to the vertical axis of the cabinet, and project into the corner area 12 such that the side surfaces 25 of the U-legs 22, positioned laterally relative to the corner area, each rest against the interior surface of the door leaf 11 as well as against the angled portion 13. These side surfaces 25 are provided with pointed projections 26 which penetrate into the abutting surfaces when the hinge is mounted, and they can, thus, also be used for grounding. The portion of the support bracket 21 connecting the U-legs 22 has a bore 23 for penetration by the fastener 24.

The second bearing support 18 is, thus, attached to the door such that the second bearing support is inserted into the cutout that is not illustrated, then the support bracket 21 is placed on top of the bearing support from the inside, and the fasting bolt 24 is threaded through the bore 23 of the support bracket 21 into the bore 20 of the second bearing support. By tightening the fastening bolt, the support bracket 21 is being tightened against the door leaf and against the angled portion and thereby secures the second bearing support 18 in the corner area 12, wherein the edges 19 of the second bearing support 18 embrace the rim portion of the cutout. Thus, a stabilization of the corner area between the door leaf 11 and the angled portion 13 is created at the same time in the area of the cutout.

The features of the object disclosed in the above description, the claims and the drawing can, individually and in any desired combination, be essential to the realization of the invention in its various embodiments.

The specification incorporates by reference the entire disclosure of German priority document 296 18 406.3 of Oct. 22, 1996 and International Application PCT/DE97/02430 of Oct. 22, 1997.

The present invention is, of course, in no way restricted to the specific disclosure of the specification and drawings, but also encompasses any modifications within the scope of the appended claims.

What is claimed is:

1. A hinge for metal cabinets comprising:

a first bearing support for mounting to a body of a metal cabinet;

a second bearing support for attachment to a door leaf of a metal cabinet by being inserted into a cutout provided in a corner area of an angled portion of the door leaf, said angled portion extending toward the body of the metal cabinet;

a rotation axle mounted in said first bearing support for interconnecting said first and second bearing supports and for being positioned at an external side of the door leaf in the area of the angled portion;

said second bearing support having a first bore;

a fastener received in said first bore for attaching said second bearing support to the door leaf;

said first bore extending angularly to the door leaf and the angled portion;

a U-shaped support bracket having U-legs embracing said second bearing support, said U-legs being adapted to rest on the door leaf and the angled portion;

said support bracket being provided with a second bore for penetration by said fastener for mounting said support bracket on said second bearing support.

2. A hinge according to claim 1, wherein said U-legs embrace said second bearing support above and below said second bearing support, relative to a vertical axis of said metal cabinet, in said corner area.

3. A hinge according to claim 1, wherein said U-legs have side surfaces aligned with the door leaf and the angled portion, respectively, wherein said side surfaces rest against the door leaf and the angled portion when said fastener is inserted.

4. A hinge according to claim 1, wherein said U-legs laterally embrace said second bearing support parallel to a vertical axis of the metal cabinet and wherein said U-legs have end faces supported on the door leaf and the angled portion.

5. A hinge according to claim 1, wherein side surfaces of said U-legs have pointed projections projecting toward respective abutting surfaces of the door leaf and the angled portion.

6. A hinge according to claim 1, wherein the axis of said first bore is aligned with an angle bisector of the angle that is formed by the door and the angled portion.

7. A hinge according to claim 1, wherein said axis of said first bore intercepts an angle bisector of the angle that is formed by the door and the angled portion.

8. A hinge according to claim 1, wherein said first bore is a threaded bore and said fastener is a screw bolt.

* * * * *

UNITED STATES PATENT AND TRADEMARK OFFICE

CERTIFICATE OF CORRECTION

PATENT NO. : 6,175,992 B1
DATED : January 23, 2001
INVENTOR(S) : Manfred Sauerland It is certified that error appears in the above-identified patent and that said Letters Patent is hereby corrected as shown below:

Title page,
Item [54], should read as follows:

Title [54]: HINGE SUITABLE FOR ROW CABINETS WITH A ROTATION AXLE POSITIONED AT THE EXTERIOR Signed and Sealed this Sixth Day of November, 2001

*Attest:*

Nicholas P. Godici

*Attesting Officer*

NICHOLAS P. GODICI
*Acting Director of the United States Patent and Trademark Office*